US008240994B2

(12) United States Patent
Ireland et al.

(10) Patent No.: US 8,240,994 B2
(45) Date of Patent: Aug. 14, 2012

(54) COOLING ARRANGEMENT

(75) Inventors: Peter T. Ireland, Derby (GB); Anthony J. Rawlinson, Derby (GB)

(73) Assignee: Rolls-Royce PLC, London (GB)

( * ) Notice: Subject to any disclaimer, the term of this patent is extended or adjusted under 35 U.S.C. 154(b) by 1143 days.

(21) Appl. No.: 12/149,165

(22) Filed: Apr. 28, 2008

(65) Prior Publication Data

US 2008/0286116 A1 Nov. 20, 2008

(30) Foreign Application Priority Data

May 18, 2007 (GB) ..... 0709562.3

(51) Int. Cl.
*F01D 5/18* (2006.01)

(52) U.S. Cl. ..... 416/97 R

(58) Field of Classification Search ..... 416/97 R; 415/115

See application file for complete search history.

(56) References Cited

U.S. PATENT DOCUMENTS 3,934,322 A * 1/1976 Hauser et al. ..... 29/889.721
4,940,388 A 7/1990 Lilleker et al.
5,062,768 A 11/1991 Marriage
5,370,499 A 12/1994 Lee
5,498,133 A * 3/1996 Lee ..... 416/97 R
5,503,529 A * 4/1996 Anselmi et al. ..... 416/97 R
6,874,987 B2 * 4/2005 Slinger et al. ..... 415/115
7,438,528 B2 * 10/2008 Goodman et al. ..... 416/97 R

FOREIGN PATENT DOCUMENTS

GB 1 226 751 3/1971
GB 2 359 595 A 8/2001
GB 2 428 749 A 2/2007

* cited by examiner

*Primary Examiner* — Ninh H Nguyen
(74) *Attorney, Agent, or Firm* — Oliff & Berridge, PLC

(57) ABSTRACT

An aerofoil for a gas turbine engine comprising a pressure wall and a suction wall and defining leading and trailing edges, the walls define a passage into which is supplied a cooling fluid, an array of cooling holes is provided through at least one of the walls to allow the cooling fluid to flow from an interior surface to an exterior surface. The array of holes comprise two groups, the holes of each group are angled to intersect the holes of the other group and are characterized in that the holes of at least one of the groups comprises two or more holes at different angles to one another to vary the porosity of the wall to account for otherwise varying wall temperatures. This arrangement also allows either less coolant mass flow to maintain a constant metal temperature, or a lower metal temperature for a given coolant mass flow.

11 Claims, 3 Drawing Sheets

COOLING ARRANGEMENT

BACKGROUND

The present invention relates to an arrangement of cooling holes in an aerofoil of a gas turbine engine.

Gas turbine blades and vanes, particularly those in the hot turbines, may require cooling and it is well known to provide a coolant flow to an internal passage of the component. Holes are provided through walls of the component so that the coolant removes heat from the wall and may form a coolant film over an external surface of the component.

U.S. Pat. No. 5,062,768 discloses a turbine blade having a wall defining multiple angled cooling holes that intersect and have a single exit. Where the holes intersect there is a constriction. This arrangement is characterised in that the cross-sectional area of flow for the coolant is greater at the exit than at the intersection, thereby avoiding blockages at the exit.

U.S. Pat. No. 5,370,499 discloses a turbine aerofoil wall having a mesh cooling hole arrangement which includes first and second pluralities of cooling holes between internal and external surfaces. The cooling holes of each plurality extend generally parallel to one another and intersect leaving internal nodes. Coolant jets interact with one another at these intersections and cause a restriction of the flow, thereby producing a pressure drop. The area of the flow inlets is substantially less than the area of the flow outlets.

SUMMARY

Although these and other conventional cooling arrangements are adequate to cool aerofoils, there is a desire to reduce the amount of coolant required thereby minimising parasitic losses and improve the efficiency of the gas turbine engine. There is also a desire to tailor the amount of cooling in certain regions of the aerofoil that may be subject to a varying temperature profile.

Therefore it is an object of the present invention to provide an aerofoil with a more efficient cooling arrangement.

In accordance with the present invention an aerofoil for a gas turbine engine comprising a pressure wall and a suction wall and defining leading and trailing edges, the walls define a passage into which is supplied a cooling fluid, an array of cooling holes is provided through at least one of the walls to allow the cooling fluid to flow from an interior surface to an exterior surface; the array of holes comprise two groups, the holes of each group are angled to intersect the holes of the other group and are characterised in that the holes of at least one of the groups comprises two or more holes at different angles to one another to vary the porosity of the wall.

Preferably, the array of holes comprising the two groups in a single row of holes.

Alternatively, there are two or more row of holes, each row comprising the two groups.

Preferably, the array of holes comprises the two groups in two or more rows of holes.

Optionally, the two or more rows of holes are divergent.

Optionally, the two or more rows of holes are convergent.

Alternatively, the holes of at least one of the groups comprise all holes at different angles to one another.

Optionally, some of the holes of at least one of the groups comprise consecutive holes inclined at increasingly steep angles to one another.

Alternatively, some of the holes of both groups comprises consecutive holes inclined at increasingly steep angles to one another and together are positioned so that they both increase the porosity of the region.

Preferably, the porosity of the wall varies through the thickness of the wall.

Preferably, the porosity of the wall is greater at its exterior surface than its internal surface.

BRIEF DESCRIPTION OF THE DRAWINGS

The present invention will be more fully described by way of example with reference to the accompanying drawings in which.

DETAILED DESCRIPTION OF EMBODIMENTS

Figure 1:
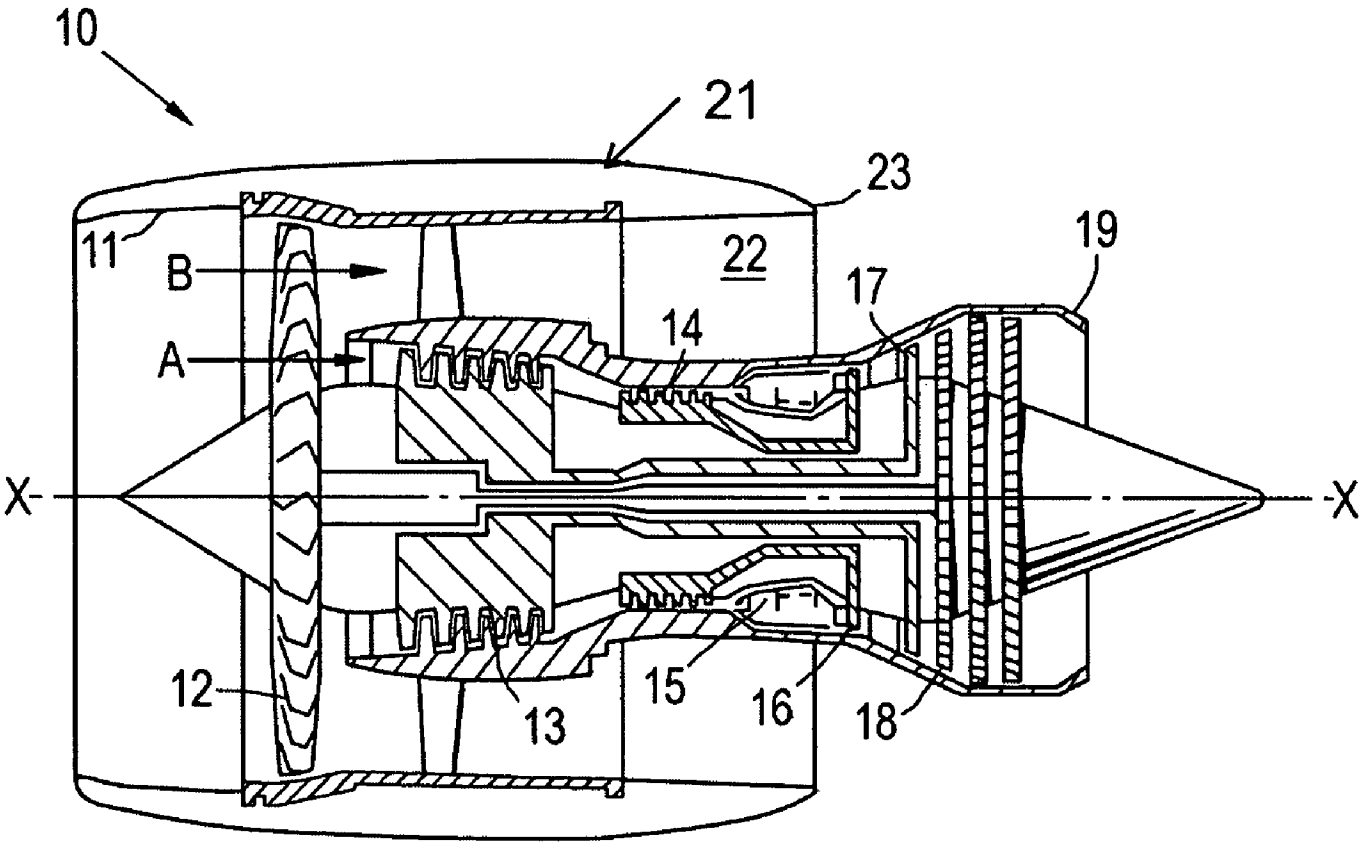
FIG. 1 is a schematic section of a ducted fan gas turbine engine.

Referring to FIG. 1, a ducted fan gas turbine engine generally indicated at 10 has a principal and rotational axis XX. The engine 10 comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core exhaust nozzle 19. A nacelle 21 generally surrounds the engine 10 and comprises the intake 11, a bypass duct 22, and an exhaust nozzle 23.

The gas turbine engine 10 works in the conventional manner so that air entering the intake 11 is accelerated by the fan 12 to produce two air flows: a first airflow A into the intermediate pressure compressor 13 and a second airflow B which passes through the bypass ducts 22 to provide propulsive thrust. The intermediate pressure compressor 13 compresses the airflow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines 16, 17, 18 respectively drive the high and intermediate pressure compressors 14, 13 and the fan 12 by suitable interconnecting shafts.

Figure 2:
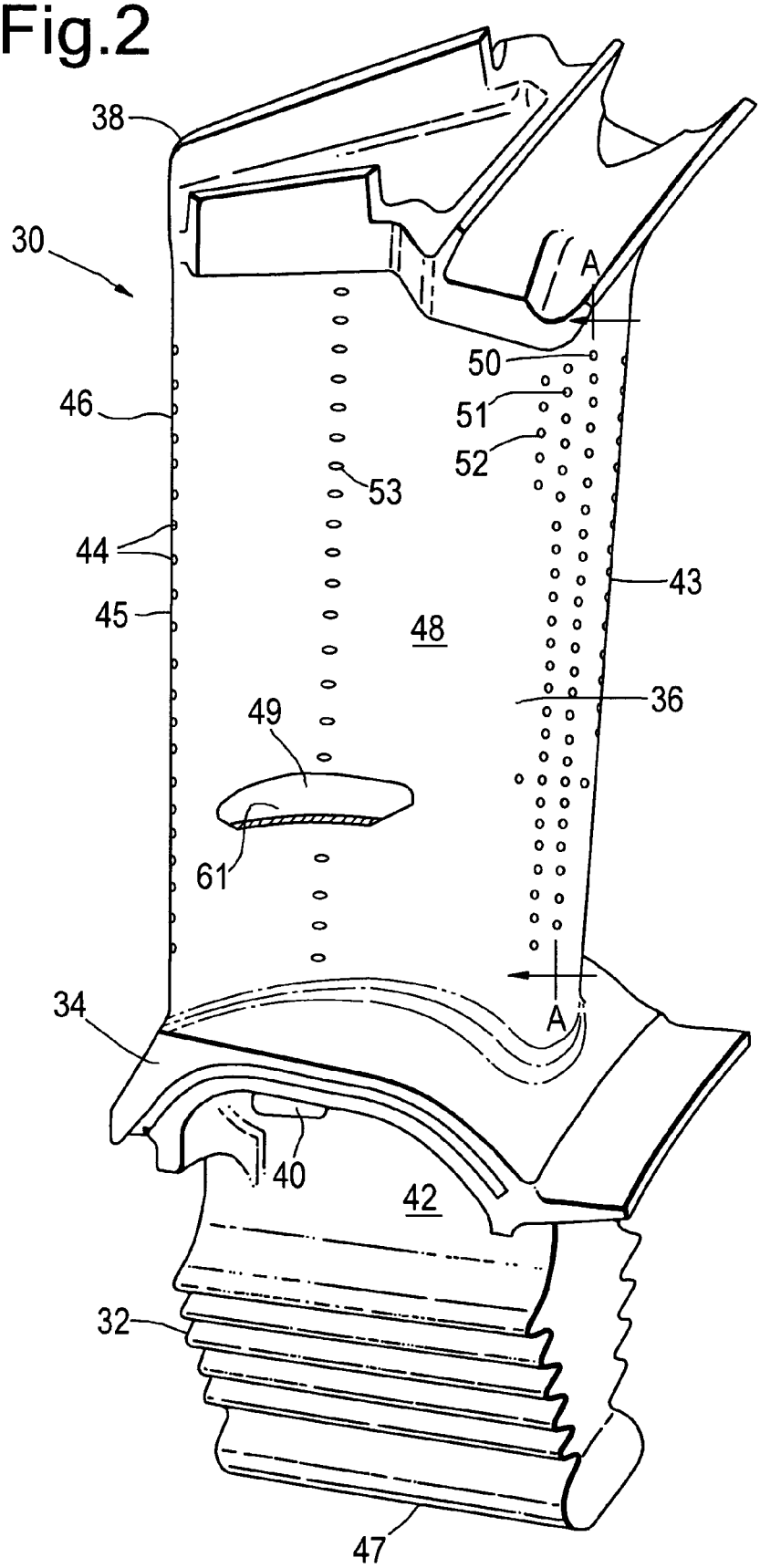
FIG. 2 is a view of a turbine blade.

Referring now to FIG. 2, a turbine blade 30, one of an annular array of blades of the high-pressure turbine 16 comprises a root portion 32, having a so-called "fir-tree" sectional shape which locates in a correspondingly shaped slot in the periphery of a turbine rotor disc (not shown); a pressure side wall 48 and a suction side wall 49 and defining therebetween leading and trailing edges 43, 45; a radially inner platform 34, which abuts the platforms of neighbouring blades to help define a gas passage inner wall for the turbine; an aerofoil 36, which extracts power from the gas flow past it; and an outer shroud portion 38 which again cooperates with its neighbours to help define the outer wall of the turbine's gas passage. Although described in relation to integrally shrouded blades, the invention is of course equally applicable to unshrouded blades as well as vanes.

The interior of the aerofoil 36 can contain a chordwise succession of substantially mutually parallel cooling air passages 61 (see, e.g., our U.S. Pat. No. 4,940,388 for exemplary details), which passages extend spanwise of the aerofoil. One or more of the passages are connected to a cooling air entry port 40 provided in the side face of an upper root shank portion 42 just below the underside of inner platform 34. This receives low pressure cooling air, which cools the aerofoil 36 by taking heat from the internal surface of the aerofoil as it flows through the internal passage and out through holes (not shown) in the shroud 38 and also through the spanwise row of closely spaced small holes 44 in the trailing edge 46 of the aerofoil. The interior of the aerofoil 36 can also contain in combination with these passages a radial succession of substantially mutually parallel chordwise passages. Others of the internal passages are connected to another cooling air entry port (not shown) located at the base 47 of the "fir-tree" root portion 32, where high pressure cooling air enters and cools the internal surfaces of the aerofoil 36 by its circulation through the passages and eventual exit through holes (not shown) in the shroud 38. It is also utilised to film-cool the external surface of the pressure wall 48 of the aerofoil 36 by means of spanwise extending rows of film cooling holes 50 to 53.

Figure 3:
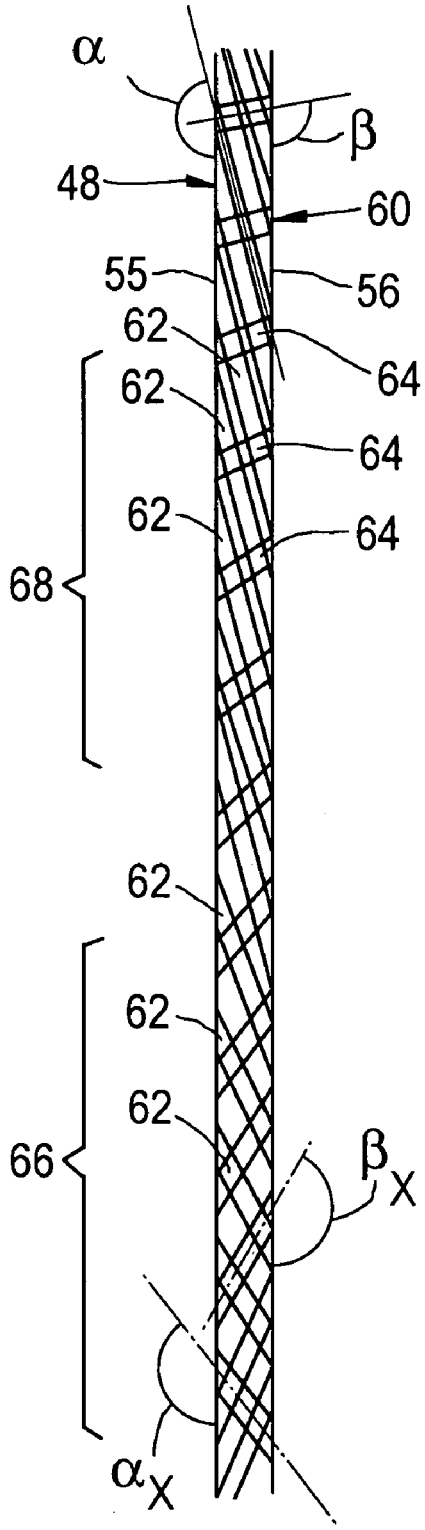
FIG. 3 is a section through a wall of the turbine blade showing first embodiment of an array of cooling holes in accordance with the present invention.

Referring now to FIG. 3, the pressure wall 48 comprises an array of cooling holes 60, in accordance with the present invention, defined by the wall 48 and extending between interior and exterior surfaces 55, 56 to allow the cooling fluid to flow therebetween. The array of holes 60 comprise a first group 62 and a second group 64 wherein the holes of each group are angled to intersect the holes of the other group and are characterised in that the holes of at least one of the groups comprises two or more holes at different angles to one another thereby creating a wall 48 of varying porosity along its radial height and therefore of preferential cooling capability.

In this embodiment, the arrangement of holes is such that the region 66 of wall 48 is more porous than region 68 and therefore there is a greater flow of coolant therethrough and a greater surface area over which the coolant flows, thereby region 66 is cooled more than region 68. This arrangement is particularly suitable where the blade's aerofoil 36 is subject to a varying temperature profile over its radial height, the hottest working gas temperature impinging on region 66. Alternatively, this arrangement may be used where the temperature of the coolant changes such that as the coolant increases in temperature, there is a corresponding increase in porosity to compensate for the lower temperature differential between coolant and wall.

In the preferred embodiment shown in FIG. 3, both groups of holes 62, 64 have all their holes angled differently to other holes in their same group. Regarding the group of holes 62, a radially outer hole is angled at $\alpha$=160° and a radially inner hole is angled at $\alpha_x$=130°. Regarding the group of holes 64, a radially outer hole is angled at $\beta$=100° and a radially inner hole is angled at $\beta_x$=135°. The consecutive holes in between these radially outer and inner holes change angle by an equal increment, although they may change by unequal amount.

It should be noted that the holes of each of the two (or more) groups of holes 62 and 64 have their longitudinal axes lying substantially in a single plane and are essentially a single row of holes, for example like row 50 in FIG. 2. As mentioned previously each group of holes 62, 64 may comprise holes at varying angles to create more and less porous regions 66, 68.

Figure 4:
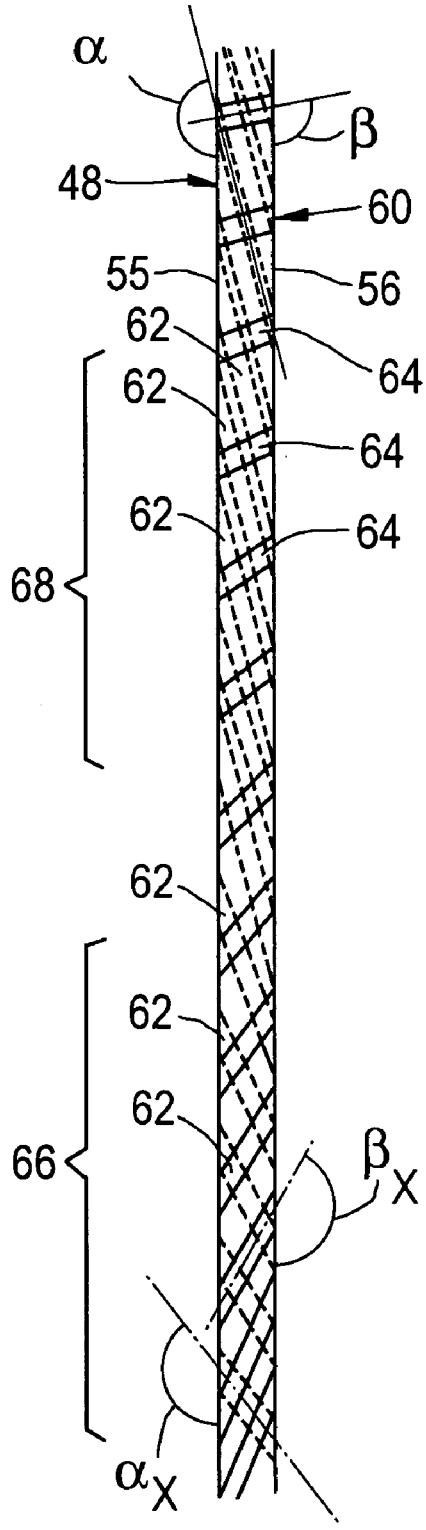
FIG. 4 is a section through a wall of the turbine blade showing second embodiment of an array of cooling holes in accordance with the present invention.

In an alternative embodiment of the present invention shown in FIG. 4, the two groups of holes 62 and 64 are separate rows, for example like rows 50 and 51 in FIG. 2. Each row has each of its holes extending in a single plane. In FIG. 4, the group of holes 62 (e.g. equivalent to row 51 in FIG. 1) are shown in dashed lines. The planes of each of the two (or more) rows are substantially normal to the surface 56 and therefore depending on the profile of the surface 56 the planes may be parallel, divergent or convergent with respect to the wall's inner and outer surfaces. Hence the rows may have the groups of holes 62, 64 intersecting or not intersecting. Thus not only does this embodiment vary the porosity by virtue of the angles of the holes in each of the two arrays 62 and 64, but also the porosity may be varied between internal and external surfaces 55, 56 dependant on the convergence or divergence of adjacent rows 50 and 51 (for example).

It should be appreciated that the planes of each of the two (or more) rows are preferably and substantially normal to the surface 56, but may be at any other suitable angle.

In yet another embodiment of the present invention each of the individual holes of either or both the groups of holes 62, 64, whether in one row or two or more, may be angled relative to a common plane through the group of holes. In other words each of the holes 62, 64 may be further angled either into or out of the paper by varying degrees. This may be done in conjunction to the varying angle $\alpha_x$, $\beta_x$ of the holes 62, 64 in the plane of the paper.

Various modifications may be made without departing from the scope of the present invention. For example, two or more adjacent holes may be parallel and angled differently than the next two or more parallel holes; consecutive holes may be inclined at increasingly steep angles relative to one another i.e. the holes are not equally incremented in their angles.

Although the arrangement of cooling holes has been described in relation to rows of cooling holes extending generally in a radial direction, the present invention is equally applicable to a transverse row of cooling holes, such that FIG. 3 represents a section B-B in FIG. 2. Furthermore, the present invention is applicable to a grid of cooling holes having rows (e.g. section B-B) and columns, thus the holes will have compound angles.

It should be appreciated that the porosity of the wall 48, 49 also varies through the thickness of the wall and in the example shown in FIG. 3, in the region 66 the porosity of the wall is greater at its exterior surface 56 than its internal surface 55.

The Applicants have found that the present invention has produced a 50% increase in a convective cooling parameter (the product of the cooling hole convective heat transfer coefficient and the exposed holes surface area). This arrangement allows either less coolant mass flow to maintain a constant wall temperature, or a lower wall temperature for a given coolant mass flow. This arrangement has provided a significant, about 50 degrees, wall temperature reduction for the same mass flow of coolant using conventional non-intersecting cooling hole arrangements.

We claim:

1. An aerofoil for a gas turbine engine comprising:

a pressure wall and a suction wall, together defining leading and trailing edges and a passage into which is supplied a cooling fluid, at least one wall of the pressure wall and suction wall having an interior surface and exterior surface, and defining an array of cooling holes to allow the cooling fluid to flow from the interior surface to the exterior surface, the array of holes defining a first group and a second group, the holes of the first group are angled to intersect the holes of the second group, wherein the holes of at least one of the groups include two or more holes positioned at different angles to one another to vary a porosity of the at least one wall dependent on a varying temperature profile.

2. The aerofoil of claim 1, wherein the array of cooling holes includes a first row of holes.

3. The aerofoil of claim 2, wherein the array of cooling holes includes two or more rows of holes, each additional row defining an additional group.

4. The aerofoil of claim 3, wherein the two or more rows of holes are divergent.

5. The aerofoil of claim 3, wherein the two or more rows of holes are convergent.

6. The aerofoil of claim 1, wherein the array of holes includes two or more rows of holes.

7. The aerofoil of claim 1, wherein the holes of at least one of the groups are at different angles to one another.

8. The aerofoil of claim 1, wherein at least one of the groups includes consecutive holes inclined at increasingly steep angles to one another.

9. The aerofoil of claim 1, wherein more than one of the holes of both groups are consecutive holes inclined at increasingly steep angles to one another and are positioned so that they increase the porosity of the region.

10. The aerofoil of claim 9, wherein the porosity of the wall is greater at its exterior surface than at its interior surface.

11. The aerofoil of claim 1, wherein the porosity of the wall varies through the thickness of the wall.

* * * * *